US009986775B2

(12) United States Patent
Hamidi

(10) Patent No.: US 9,986,775 B2
(45) Date of Patent: Jun. 5, 2018

(54) CONVERTIBLE GARMENT FOR CARRYING AND FEEDING INFANTS

(71) Applicant: MOMME TOP LLC, San Diego, CA (US)

(72) Inventor: Lisa Ruth Hamidi, San Diego, CA (US)

(73) Assignee: MOMME TOP LLC, San Diego, CA (US)

( * ) Notice: Subject to any disclaimer, the term of this patent is extended or adjusted under 35 U.S.C. 154(b) by 0 days. days.

(21) Appl. No.: 15/368,526

(22) Filed: Dec. 2, 2016

(65) Prior Publication Data

US 2017/0196284 A1 Jul. 13, 2017

Related U.S. Application Data

(60) Provisional application No. 62/276,823, filed on Jan. 9, 2016.

(51) Int. Cl.
*A41D 1/00* (2018.01)
*A41D 15/04* (2006.01)
(Continued)

(52) U.S. Cl.
CPC ..... *A41D 15/04* (2013.01); *A41C 3/04* (2013.01); *A41D 1/215* (2018.01); *A47D 13/02* (2013.01)

(58) Field of Classification Search
CPC . A45C 11/20; A41D 1/00; A41D 1/20; A41D 1/04; A41D 13/00
(Continued)

(56) References Cited

U.S. PATENT DOCUMENTS 41,697 A 12/1889 Taylor
1,206,480 A * 11/1916 Stagg ..... A41D 1/205 2/104
(Continued)

FOREIGN PATENT DOCUMENTS

FR 2859613 A1 3/2005
WO 2003099048 A2 12/2003
(Continued)

OTHER PUBLICATIONS

International Search Report and Written Opinion dated Mar. 14, 2017 for related International Application No. PCT/US2016/067533, in 7 pages.

*Primary Examiner* — Brian D Nash
(74) *Attorney, Agent, or Firm* — Procopio, Cory, Hargreaves & Savitch LLP

(57) ABSTRACT

A garment designed to convert back and forth between a cover mode for nursing an infant and a carrier mode for carrying an infant or other animate or inanimate object has a first layer designed to loosely cover an attached inner layer or separate garment covering an upper torso of a wearer in the cover mode. The first layer has a neck opening, a back, a front, opposite sides, left and right arm openings, and a faux pocket slit on each side spaced below the respective arm opening and configured for insertion of a wearer's arm through the faux pocket slit and between the first layer and inner layer or garment. After inserting an arm, the wearer can turn a lower portion of the first layer inside out while moving the slit along the arm and over the shoulder to form a sling-like carrier in the carry mode.

18 Claims, 10 Drawing Sheets

(51) Int. Cl.
*A41C 3/04* (2006.01)
*A47D 13/02* (2006.01)

(58) Field of Classification Search
USPC ..... 224/577, 159, 158
See application file for complete search history.

(56) References Cited

U.S. PATENT DOCUMENTS 2,597,948 A 5/1952 Phillips
2,661,472 A * 12/1953 Miller ..... A41D 1/22 2/105
4,079,467 A 3/1978 Baldwin
4,144,593 A * 3/1979 Timmons ..... A41D 1/205 2/104
4,208,743 A * 6/1980 Whitcraft ..... A41D 1/205 2/104
4,458,365 A * 7/1984 Wood ..... A41D 1/205 2/104
4,567,611 A 2/1986 Kendrick
4,606,078 A 8/1986 Tkacsik
4,663,782 A 5/1987 Knox et al.
4,757,925 A 7/1988 Knittel
4,843,647 A * 7/1989 Phillips, Sr. ..... A41D 15/04 2/115
5,090,059 A 2/1992 Kahl
5,205,450 A 4/1993 Derosier
5,440,763 A * 8/1995 Shah ..... A41D 13/1236 2/105
5,461,725 A * 10/1995 Witczak ..... A41D 1/205 2/104
5,632,425 A 5/1997 Hull
5,678,739 A 10/1997 Darling et al.
5,685,466 A 11/1997 Hsieh
5,857,598 A 1/1999 Dunne
5,946,725 A 9/1999 Shatzkin et al.
5,950,887 A 9/1999 Powell
6,213,362 B1 4/2001 Lorenzini
6,550,067 B2 * 4/2003 Force ..... A41D 1/205 2/104
6,595,396 B2 7/2003 Cummings et al.
D614,861 S 5/2010 Smyth et al.
7,810,171 B2 10/2010 Moore
D630,838 S 1/2011 Gmeiner et al.
2002/0011503 A1 1/2002 Hwang
2004/0083529 A1 * 5/2004 Tate ..... A41D 13/0015 2/115
2004/0139526 A1 7/2004 Davis
2004/0149790 A1 8/2004 Kassai et al.
2005/0133551 A1 6/2005 Heidt
2006/0261104 A1 11/2006 Zambrzycki
2007/0029356 A1 2/2007 Moriguchi et al.
2007/0249263 A1 10/2007 Itzhak
2007/0278264 A1 12/2007 Chesal et al.
2008/0149674 A1 6/2008 Hiniduma-Lokuge
2010/0107300 A1 5/2010 Yiu
2011/0163136 A1 7/2011 Billingham
2012/0248159 A1 10/2012 Rahni
2013/0200116 A1 8/2013 Arvan
2013/0269082 A1 10/2013 Bramblet
2013/0299532 A1 11/2013 Jacobs
2014/0166705 A1 6/2014 Vukovics

FOREIGN PATENT DOCUMENTS

WO 2005025347 A2 3/2005
WO 2008098882 A2 8/2008
WO 2009081400 A2 7/2009
WO 2011070498 A1 6/2011
WO 2012092655 A1 7/2012
WO 2013124554 A2 8/2013
WO 2013124554 A3 8/2013

* cited by examiner

CONVERTIBLE GARMENT FOR CARRYING AND FEEDING INFANTS

CROSS-REFERENCE TO RELATED APPLICATIONS

This application claims the benefit of U.S. Provisional Patent Application No. 62/276,823 filed on Jan. 9, 2016, entitled "Carry, Cover, Feed Garment" and the contents of the aforementioned application are incorporated by reference herein in their entirety.

BACKGROUND

1. Technical Field

The various embodiments described herein are generally related to garments for carrying, covering and feeding infants.

2. Related Art

Baby carrier devices typically used by parents to carry babies close to their body are subject to several inconveniences. There are numerous different carrier types, including backpack-like carriers, wraps, slings, and the like. Often these require a second person to secure the device around the carrier's body while the wearer supports the baby, and can be uncomfortable for both baby and carrier. Such devices also tend to include a significant amount of fabric, creating a hot environment for the baby and the person carrying the baby. The carrier is also another sizable item taking up space in the diaper bag which parents must remember to pack and take with them on trips or outings.

Breastfeeding mothers also have problems when they need to feed their baby in a public place or even at home when they have visitors. One current solution is a cover which is secured around the mother's neck and draped over the infant. The mother generally cannot see the baby when using such a cover, and there can still be a lack of privacy since the coverage is not 360 degrees and there may be gaps and slipping of the material. Additionally, such covers can be hot and uncomfortable to use.

Parents typically have to tote around a large amount of equipment when travelling or the like with a baby, and currently both a baby carrier and a separate nursing cover is needed in addition to a diaper bag, diapers, wipes, toys and the like.

What is needed is a convenient device which allows for easy carrying of a baby as well as permitting feeding of a baby in public or amongst other people in a discrete and private manner, without requiring a separate cover.

SUMMARY

In one aspect, a garment is provided which is readily convertible back and forth between a cover mode and a carry mode.

According to various embodiments, there is provided a convertible garment which is convertible back and forth between a cover mode and a carry mode. The garment has a first or outer layer designed to be worn loosely over an attached second or inner layer forming part of the convertible garment, or over a separate inner item of clothing of the wearer in embodiments in which the convertible garment comprises only one layer. The outer layer has a neck opening, a back, a front, opposite sides, a lower hem portion, and opposite left and right arm openings. The opposite sides each have a "faux" pocket slit or side opening beneath the respective arm opening and close to the hem portion through which an arm of a wearer on the same side as the slit can be inserted between the first or outer layer and the underlying inner layer or item of clothing. The dimensions of the garment are such that the wearer can turn a lower portion of the garment below the respective slit inside out after inserting an arm through the adjacent faux pocket slit, and move the slit up the arm and over the wearer's shoulder into the carry mode. In the carry mode, the inverted portion of the garment cooperates with the underlying upper portion of the garment to form a sling-like carrier for a baby, this forms an opening between the hem portion and an opposing outer surface region, the underlying upper portion, of the first or outer layer.

In some embodiments, the convertible garment is a single or outer layer which may be worn over an inner garment such as an undershirt, tank top, short or long sleeved shirt or the like for coverage when the lower portion of the garment is raised upwards to form the sling. In some embodiments, the convertible garment itself may have a second or inner layer permanently or releasably secured to the outer layer, so that the wearer does not have to first don a separate, inner garment. When the wearer wishes to feed the baby, they simply convert the garment back to its original cover mode, adjust the undershirt or other inner garment to allow for feeding while covered by the outer layer, and insert the baby between the outer and inner layer or undershirt for full coverage while feeding.

In some embodiments, the lower portion of the first or outer layer is loose fitting and has a lower hem portion including a tightening mechanism which permits the sling opening to be tightened or reduced in size when the garment is in the carry mode, and to be loosened or increased in size when converting from carry mode back to cover mode. The tightening mechanism may comprise an elasticated hem or the hem portion may form a channel running around the base of the outer layer, with one or more cords or other elongated members extending through the channel. In the latter alternative, openings are provided in the channel on each side of the outer layer below the faux pocket slits, and end portions of the cord or cords protrude out of the channel openings and are secured with an adjustable cinch or fastener device such as a toggle or the like. The wearer can tighten the cord to reduce the sling opening size when the garment is converted into the carry mode, and can loosen the cord when converting back from carry mode to cover mode.

The convertible garment avoids the need for parents or other childcare providers to transport both a baby carrier and extra feeding cover when away from home with an infant. The convertible garment allows the infant to be carried close to the body while walking, traveling, shopping or the like while providing for privacy when breast feeding a baby in a non-private environment. It will be understood that the convertible garment also allows for use in other capacities, for example to carry a pet such as a dog, cat or the like, or to carry shopping or other items in a convenient manner.

Other features and advantages of the present inventive concept should be apparent from the following description which illustrates by way of example aspects of the present inventive concept.

BRIEF DESCRIPTION OF THE DRAWINGS

FIG. 6 is an inside view of a front panel hem area of the garment in one embodiment, illustrating an optional loop or ring secured to the hem for carrying baby toys, teethers, pacifiers and the like;

DETAILED DESCRIPTION

While certain embodiments are described, these embodiments are presented by way of example only, and are not intended to limit the scope of protection. The methods and systems described herein may be embodied in a variety of other forms. Furthermore, various omissions, substitutions, and changes in the form of the example methods and systems described herein may be made without departing from the scope of protection.

According to various embodiments, an article of clothing or garment configured for wearing over at least an upper portion of a wearer's body is convertible between a carrier mode for carrying a baby or other animate or inanimate objects such as pets, shopping items or the like, and a cover mode for normal wear and for feeding a baby in a concealed manner. The garment is configured to fuse critical functions of carry, cover and feed into one construction to allow the wearer to move seamlessly and discretely from feeding to carrying a baby, or other similarly weighted object or living thing, without requiring any additional devices since the carry and cover functionality is provided by a single garment. In one embodiment, the convertible garment may be shirt-like in design and may comprise a single or outer layer for wearing over another garment such as an undershirt, tank top, short or long-sleeved shirt or the like. In other embodiments, the garment may have two layers, specifically a first or outer layer and an attached second or inner layer or tank top for covering parts of the user's torso in the carry mode. The dimensions of the garment are such that the wearer can turn a lower portion of the garment (where it is a single layer) or outer layer of a two layer garment inside out to form a sling-like carrier for a baby. When the wearer wishes to feed the baby, they simply convert the garment back to its original cover mode, adjust the undershirt or inner layer to allow for feeding while covered by the outer layer, and insert the baby between the outer layer and undershirt where the garment has one layer only, or between the outer layer and inner layer where the convertible garment comprises two layers. This provides full coverage for the wearer while feeding. In some embodiments, the inner layer is body hugging while the outer layer is loose fitting to allow sufficient material for converting into the carry or sling mode and to provide space for the baby in the cover mode. In yet other embodiments the hem or base of the outer layer could be gathered or loosened further to make it fit more tightly or flowy, respectively.

Figure 10A:
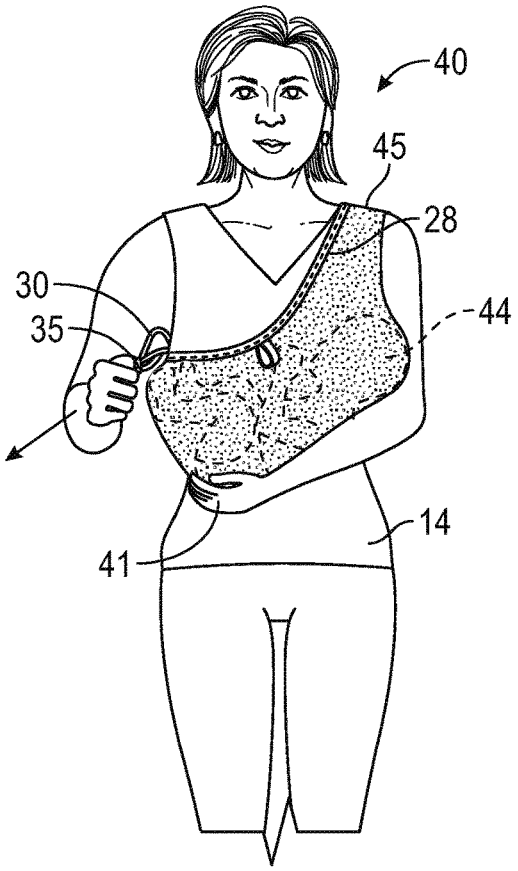
FIG. 10A illustrates a first step in converting the garment back from carrier mode of FIG. 9 to the cover mode.
Figure 10B:
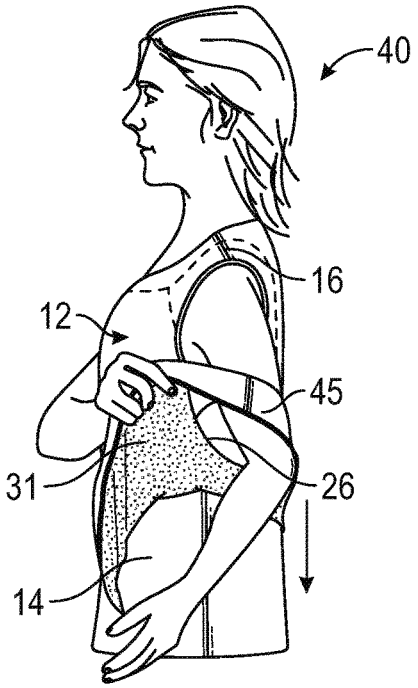
FIG. 10B illustrates a second step in returning the garment to cover mode.
Figure 11A:
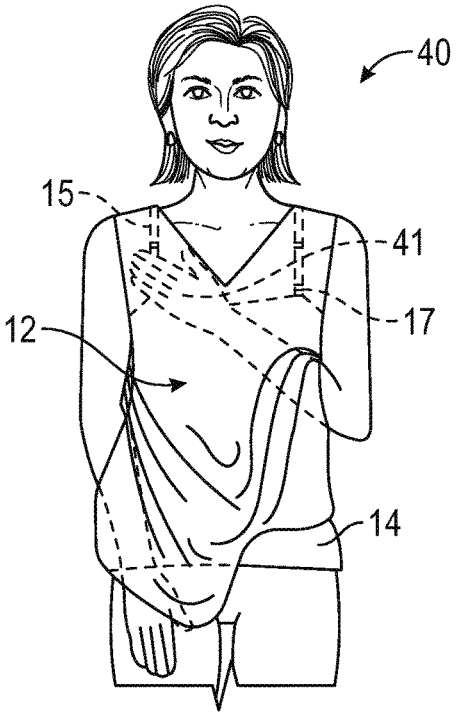
FIGS. 11A and 11B illustrate a user releasing the right or left hand strap of the inner layer, depending on which side the baby is to be fed.
Figure 11B:
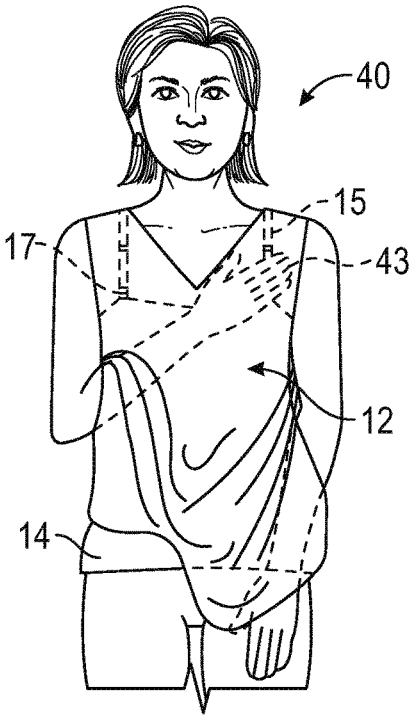
Figure 11C:
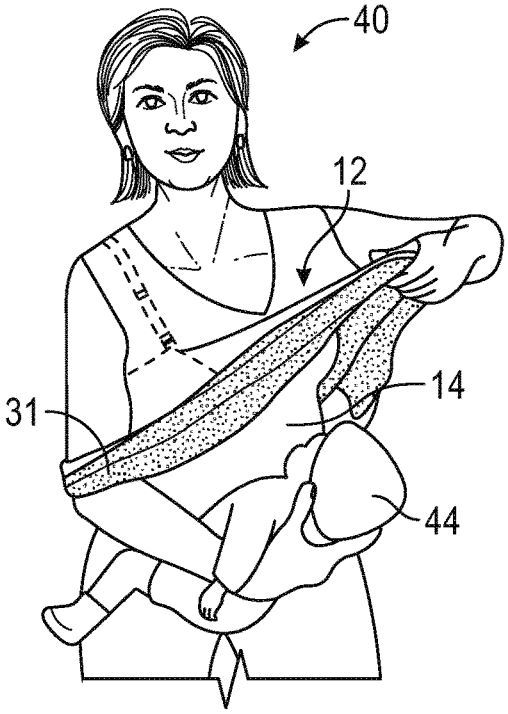
FIG. 11C illustrates the wearer placing one hand through a side slit of the outer layer while holding the baby and moving the baby under the outer layer.
Figure 11D:
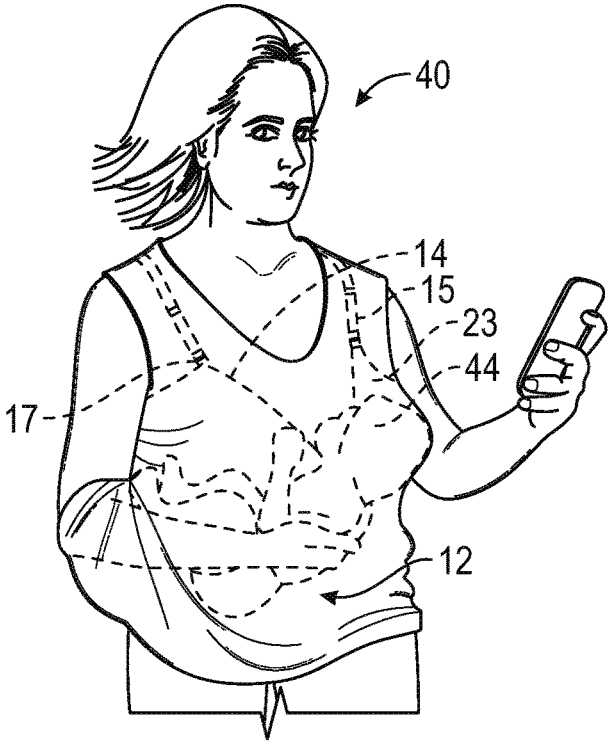
FIG. 11D illustrates the wearer feeding the baby while both the baby and the wearer are fully covered by the outer layer of the garment.
Figure 12:
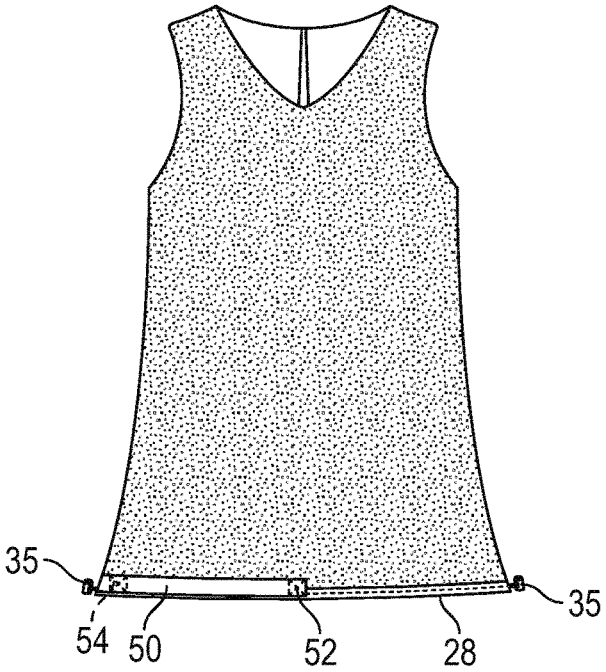
FIG. 12 is a front elevation view of the outer layer of a modified convertible garment turned inside-out to reveal the inner surface in a modified embodiment.
Figure 13A:
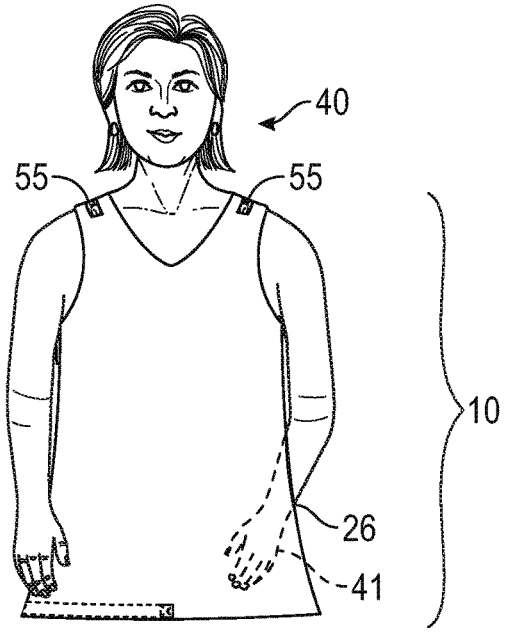
FIG. 13A is a front elevation view of the modified convertible garment of FIG. 12 being worn by a user with their left arm inserted through the side slit in a first stage of converting the garment into an infant carrier.
Figure 13B:
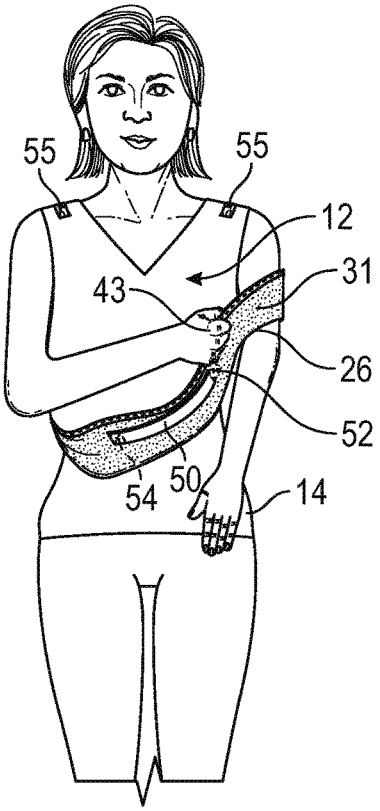
FIG. 13B is a front elevation view illustrating the wearer turning the lower part of the garment inside out and moving the left hand side up the user's arm and over their shoulder to support the carrier.
Figure 13C:
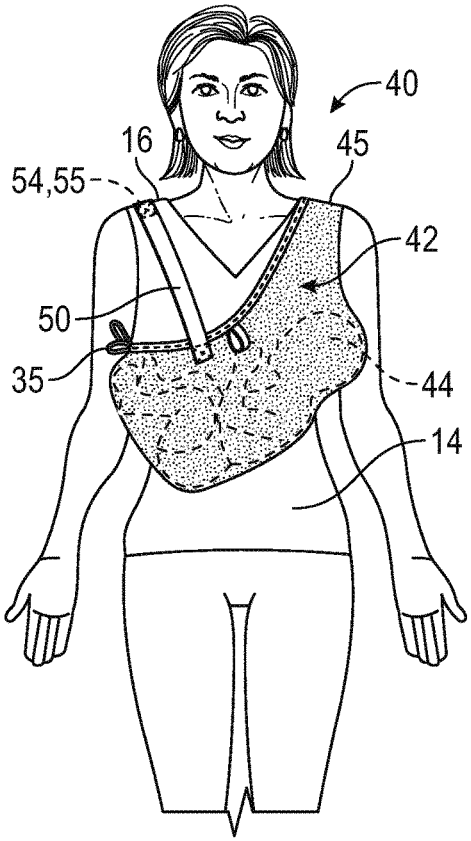
FIG. 13C is similar to FIG. 9 and illustrates the carrier mode of the modified garment with a carried infant shown in dotted outline, with the additional support strap attached to the right shoulder of the garment.
Figure 13D:
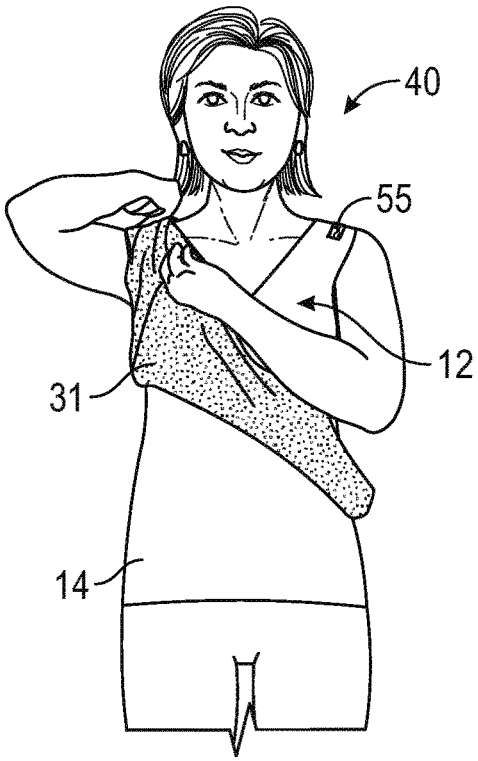
FIG. 13D is similar to FIG. 13B but illustrates the wearer after inserting their right arm through the right side slit in the garment and turning the lower part of the garment inside out while moving the right hand side up the wearer's arm and over their right shoulder.
Figure 13E:
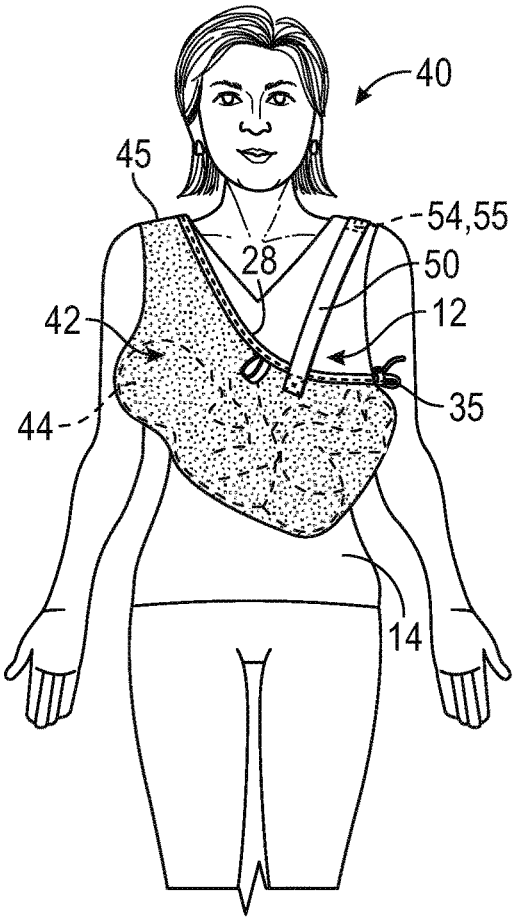
FIG. 13E is similar to FIG. 13C and illustrates the opposite carrier position from FIG. 13C with the additional support strap secured to the left shoulder of the garment.

FIGS. 1 to 11B illustrate one embodiment of a garment 10 which is convertible between carrier and cover modes, for example for carrying and nursing or breastfeeding of infants, while FIGS. 12 to 13E illustrate a modified embodiment. The garment 10 is designed to look and be worn like a regular shirt. In the illustrated embodiment, the garment is sleeveless and has two layers, comprising outer layer 12 and inner layer 14 as illustrated in FIGS. 1 to 3B, but may have sleeves in other embodiments. Additionally, the garment may comprise only a single layer such as layer 12 in other embodiments, in which case the garment can be worn over any of the wearer's existing upper body attire.

Figure 1:
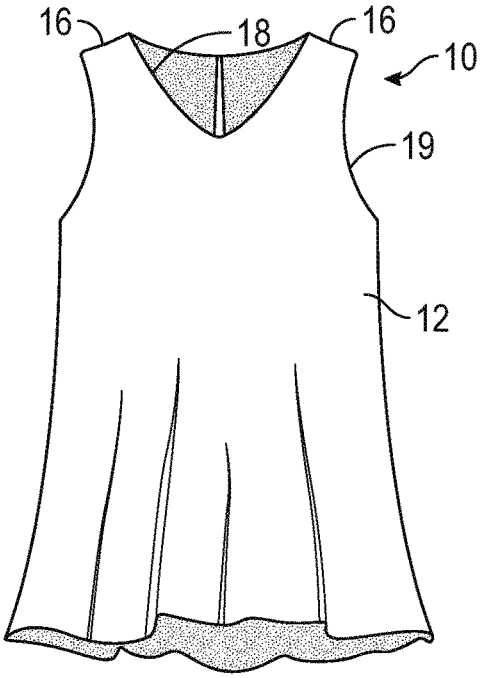
FIG. 1 is a front elevational view of one embodiment of a convertible garment.
Figure 2:
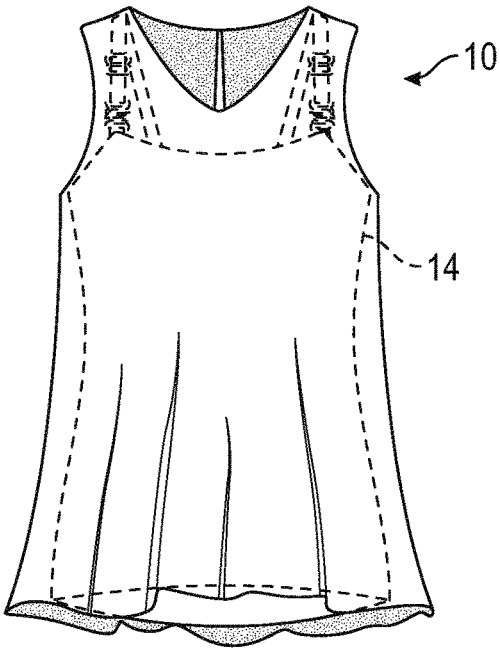
FIG. 2 is a front elevational view illustrating an undershirt or inner layer of the garment in dotted outline beneath an outer, first layer of the garment, according to an embodiment.
Figure 3A:
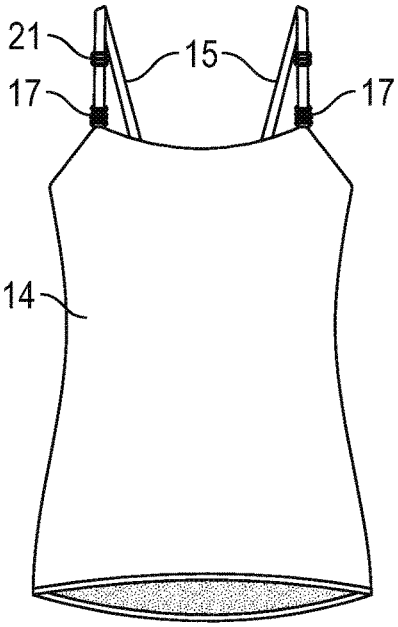
FIG. 3A illustrates a front elevational view of the inner layer of the garment.
Figure 3B:
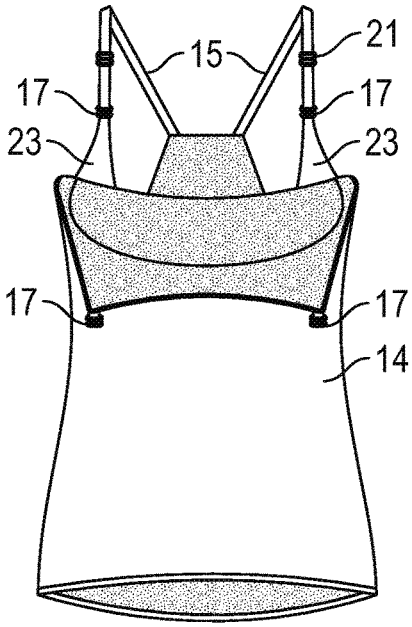
FIG. 3B illustrates a front elevational view of the inner layer or undershirt with the front straps released.

Inner layer 14 in the illustrated embodiment is shown in dotted outline in FIG. 2, and is shown separate from outer layer 12 in FIGS. 3A and 3B. The outer layer is relatively loose fitting FIG. 2. The inner layer 14 may be in the form of a tank top or the like with releasable shoulder straps 15 in one embodiment, but other types of garments easily convertible for breastfeeding purposes may be used. In this embodiment, the inner layer 14 may be permanently or releasably secured to the outer layer, for example by securing upper parts of the straps 15 as seen in FIGS. 3A and 3B to the inner side of the shoulder portions 16 of outer layer or garment 12, see FIG. 2. Outer layer 12 may be secured to an inner layer through a connective finishing such as snaps, stitching, hook and eye fasteners, hook and loop fastener material such as VELCRO®, latches or the like. The outer layer 12 may alternatively be a single layer garment and be worn over other nursing tops, regular tank tops, or other upper torso covering garments including shirts or dresses, for example a separate undershirt similar to inner layer 14, with the single layer outer garment ready for use to carry an infant and as a cover for feeding or nursing the infant.

According to some embodiments, each strap 15 of the inner layer 14 or garment has an easy-open fastener 17 such as a releasable snap fastener above the breast area, so that the front part of the garment can be released and folded down on one or both sides for feeding purposes, as illustrated in FIG. 3B. The tank top snap fastener may be similar to snaps on conventional nursing bras. As seen in FIGS. 3A and 3B, the front end of each strap 15 at fastener 17 is secured to a connector strip or anchor flap 23 of material which extends from the strap end to inside the front of the garment towards the respective side of the garment, where it is fastened via stitching to the side seam so that it does not restrict the top part of the tank top from folding down as in FIG. 3B. Connector strip or anchor flap 23 prevents the released tank strap 15 from snapping back behind the wearer once unlatched, so that the wearer can easily re-attach the front of the garment to the strap when finished. This is similar to a nursing bra arrangement but the anchor flap 23 in this arrangement is secured to the side seam rather than the base hem as in a nursing bra. The straps 15 may also include conventional length adjusters 21. Inner layer 14 may also include an additional, bra-like internal supporting structure for breast support in some embodiments.

Figure 4:
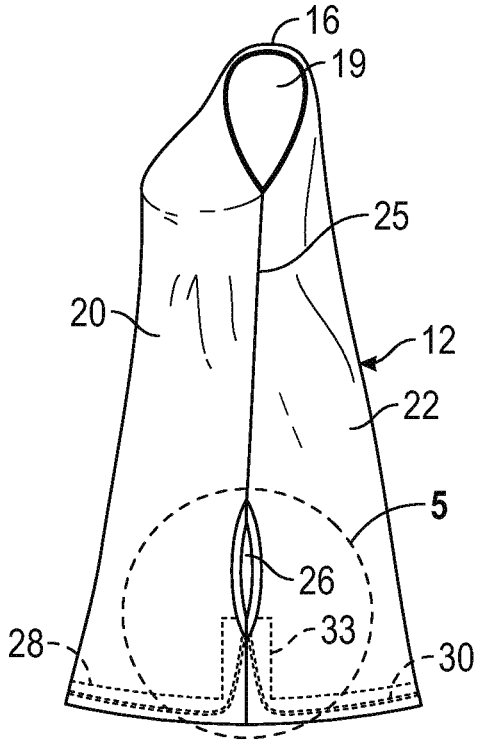
FIG. 4 is a side elevation view of the left side of the garment illustrating a side opening or "faux" pocket slit spaced above the lower edge.
Figure 5:
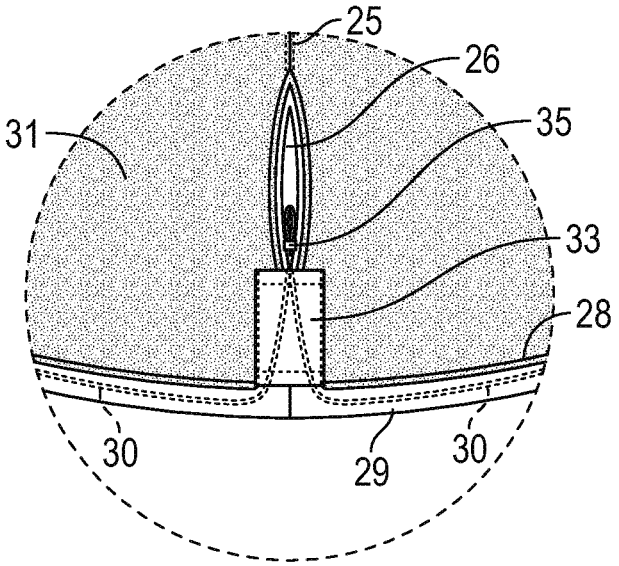
FIG. 5 is a view of the circled area 5 in FIG. 4, taken from the inside of the first or outer layer of the garment.
Figure 6:
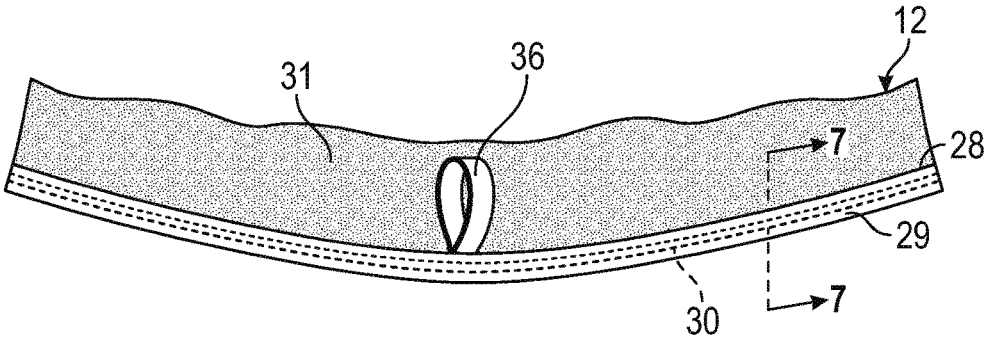
Figure 7:
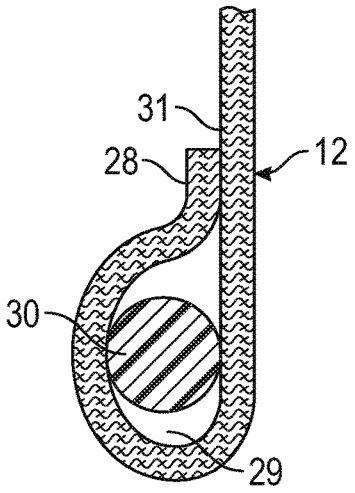
FIG. 7 is a cross-section on the line 7-7 of FIG. 6, illustrating the lower hem forming a channel for carrying a tightening cord.

In one embodiment, outer garment or layer 12 has a neck opening 18 and arm openings 19 and may be constructed from one, two or more panels. Referring to FIG. 4, in various embodiments, layer 12 comprises a front panel 20 and a back panel 22, connected by seams 24 (FIG. 8A), 25 at the shoulders and the sides, respectively, and openings on each side for the left and right arm. A slit or opening 26 is provided on each side of the garment to allow access under layer 12. In some embodiments, openings 26 are located at a region corresponding to the hip region of the wearer, but they may be located elsewhere in some variations. The openings or slits 26 may be referred to as "faux" pockets. A hem 28 is provided at the lower edge of garment or outer layer 12 and has front and rear portions extending between the faux pockets 26 on each side, as illustrated in FIGS. 4 to 6. In some embodiments, the outer layer has a length sufficient to extend over at least the wearer's torso down to the hip region or lower. In some embodiments, the hem portion at the back panel may be designed to hang lower for a discrete bottom fit.

In the illustrated embodiment, hem 28 forms a channel 29 along the lower edge of the inner surface 31 of outer layer 12. An elongate flexible member 30 such as a cord, rope, line or the like is threaded through the channel and extends out of openings at each side of the outer layer 12. In some embodiments, member 30 may be of elastic material. A single flexible member or cord may extend through the channel with free ends on one side of the garment and a loop protruding at the opposite side, or separate elongate members may extend through front and rear portions of the channel, respectively, with free ends protruding from openings at each side of the garment. In some embodiments, a small pocket or sleeve 33 or the like is attached on the inner surface 31 at each side of the garment beneath the respective opening or faux pocket 26 for guiding and securing loose ends or loops of the cord or cords 30 protruding from opposite ends of each hem portion at the sides of the garment, as best illustrated in FIGS. 4 and 5. The pocket or sleeve 33 may be excluded in other embodiments or replaced with a small loop through which the loose ends of the cord extend. The loose ends are adjustably secured or fused together with a toggle or similar adjustable fastener or closure 35 located at or near the respective faux pocket 26 within reach of the wearer's fingers when their hand is inserted through pocket or opening 26. Toggle 35 may be any type of secure closure which allows cords to be pulled through it or adjusted when released. This allows the perimeter of the lower edge of the garment to be increased or decreased in length before securing the closure to grasp the cord or cords. The closure may comprise one of the following fasteners in one example: a tie, hook and loop fastener, snap, button, pulley, buckle, clasp, military grade closure, or the like. Other types of fastener may be used in alternative embodiments. In some alternative embodiments, the channel and cord at the hem may be replaced with an elasticated hem portion or the like which can be expanded manually as needed when converting between carry and cover modes. In one embodiment, a small loop or ring 36 is secured or sewn roughly at the middle of front portion of hem 28 at or near the front hem portion, as illustrated in FIG. 6. This may be used as a connector for various items within the reach of the baby when carried, for example teethers, pacifiers, rattles, toys or the like. Additional loops may be provided in some embodiments, and the loop 36 may be positioned at any location which can be reached by the baby when the garment is in the sling or carrier mode.

Figure 8A:
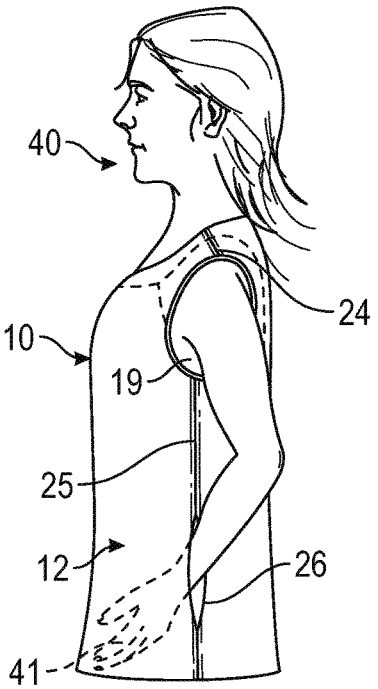
FIG. 8A is a left side elevation view of a user wearing the convertible garment, illustrating a first step in converting the garment into the carrier mode.
Figure 8B:
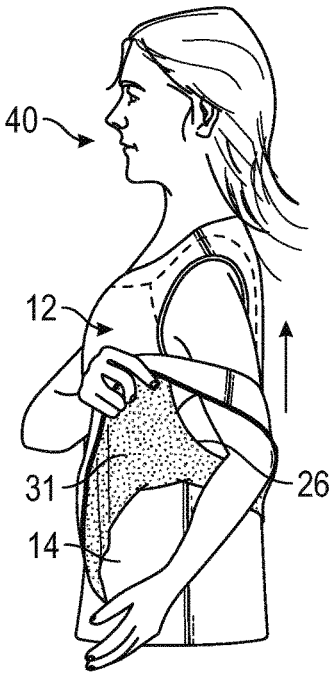
FIG. 8B is a left side elevation view similar to FIG. 8A, illustrating a subsequent step in converting the garment into the carrier mode.
Figure 9:
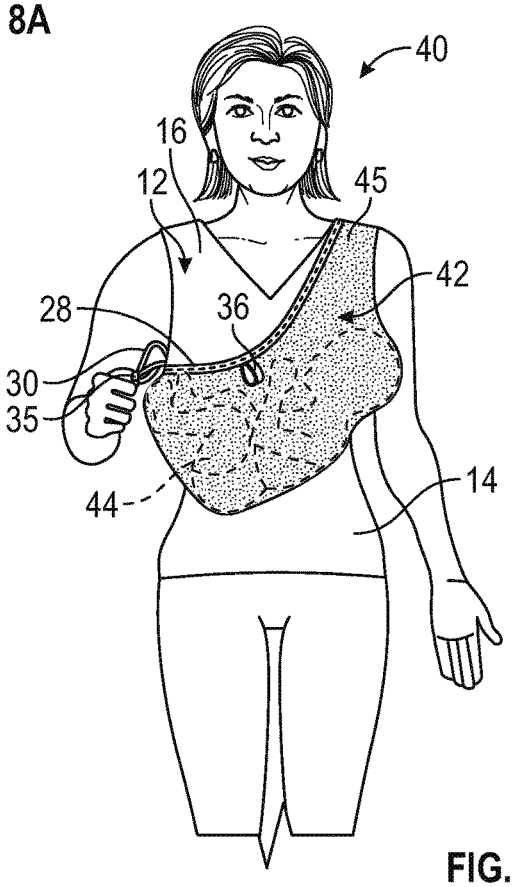
FIG. 9 is a front elevation view illustrating the lower portion of the outer layer of the garment turned inside out to form a sling-like carrier supported over the wearer's left shoulder, with a baby shown in the carrier in dotted outline.

FIGS. 8A to 9 illustrates steps for converting the garment 10 from a cover mode into a carry mode. When moving into carry function, the wearer 40 simply inserts one hand 41 into the pocket on the same side of the outer layer 12 between the outer layer and inner layer or garment 14, as illustrated in FIG. 8A. The lower portion of the outer layer is then turned inside out while sliding the lower portion around pocket or slit 26 up towards the wearer's shoulder, as in FIG. 8B. Once one side of the turned over lower portion of the layer 12 is secured over the wearer's shoulder as in FIG. 9, a sling or carrier 42 is formed between opposing portions of layer 12. The wearer can then tighten the ends of cord 30 at the opposite side of their body (adjacent the pocket on that side) and cinch and close the toggle 35 to secure the tightened cord, as illustrated at the wearer's right hand in FIG. 9, thereby reducing the size of the opening in the sling or carrier 42 between opposing portions of layer 12. The wearer may use one or both hands for tightening purposes. A carried baby 44 is shown in dotted outline by way of example in FIG. 9. In this embodiment, the upper end 45 of the sling is secured over the wearer's left shoulder while the toggle 35 and cord ends are on the right side of the wearer's body. The wearer may also opt to have the sling the opposite way around, by inserting their right hand through the right hand opening 26 and turning over the lower portion of the outer layer before moving it up the right arm and over the right shoulder to form a sling extending from the right shoulder to the left side of the wearer. In the carry position of FIG. 9, the optional ring or loop 36 is exposed on the edge of the sling 42 and can be used for convenient attachment of a pacifier, rattle, or other small toy. In some embodiments, an optional cloth or terry cloth swatch of material (not illustrated) may also be attached at a convenient position at the base of the outer layer for wiping the baby's mouth or other wetness.

FIGS. 10A and 10B illustrate a wearer 40 converting the garment from the carry mode of FIG. 9 to the cover mode. In FIG. 10A, the user holds the infant 44 with their free arm 41 (in this case the left arm) while concurrently releasing the previously cinched toggle 35 with the opposite hand to loosen the sling tension. If necessary, both hands may be used to uncinch the toggle, while still cradling the baby. Once loosened, the wearer moves the raised side 45 downwards back into original position by moving their arm back through the faux pocket slit 26 which is moved down over the wearer's arm in the direction of the arrow in FIG. 10B. Once the wearer's hand is free of pocket opening 26, outer layer 12 returns to a loose position as in FIG. 8A covering at least the torso portion of the inner layer or other inner garment where the convertible garment comprises only one layer. In this position, the wearer inserts their hand through the neck 18, arm 19, faux pocket 26 or base opening of the top or outer layer 12 and between the inner and outer layers of the garment to release the strap latch 17 above the breast on the inner layer or tank top 14. In FIG. 11A, the wearer is shown inserting their left hand 41 and lower arm through the adjacent slit 26 to release the strap latch 17 on the right hand shoulder. In FIG. 11B, the wearer has inserted their right hand 43 and lower arm through the faux pocket slit on the right hand side to release the strap latch 17 on the left hand shoulder. Once one or both straps 15 are released, the wearer can move the fabric below the breast ready for nursing. Because the top layer is relatively loose fitting over the wearer's upper body, these actions may be completed with substantially or completely 360 degree concealment or discretion without the need for additional or separate covers.

Once the wearer is ready, they can move the infant into position by inserting the infant under the top layer 12, lifting the lower edge or base of top or outer layer 12 first to provide space for the infant, as illustrated in FIG. 11C. The infant is inserted at the base of the shirt and covered by the top layer. It should be noted that the wearer can release the strap 15 before or after the infant is moved under layer 12 in the cover mode of FIG. 11D. Anchor flap 23 secures the free end of strap 15 at the front of the wearer's body during feeding, as illustrated in dotted outline in FIG. 11D. The wearer can then use the faux pocket slits 26 on either side of the outer layer to position and/or adjust the breast and/or the baby, with at least substantially full concealment by outer layer 12. As illustrated in FIG. 11D, the wearer has one hand free during feeding while the other hand supports the baby. The second faux pocket slit may be used to insert the free hand under the outer layer in order to hold the baby's head or adjust the baby or other items.

When the infant is done feeding, the wearer removes the infant the opposite way he or she was originally inserted and uses the same access methods for securing the inner layer strap latch 17 as used in releasing the selected strap 15. The wearer can now convert back into the carry mode in the manner described above.

FIGS. 12 to 13E illustrate a modified embodiment in which an optional reinforcement strap 50 is provided for added security in the carry mode, as well as fasteners for releasably securing the reinforcement strap in operative and inoperative conditions, as discussed in more detail below. Other parts of the modified garment are identical to corresponding parts in the previous embodiment, and like reference numbers are used for like parts as appropriate.

FIG. 12 illustrates outer layer 12 of the garment 10 turned inside out to reveal inner surface 31. As in the previous embodiment, a hem 28 runs along the lower edge of layer 12 and forms a channel carrying cord or cords 30 across the front and rear of layer 12 between the opposite side seams. In one variation, reinforcement strap 50 runs across half of the front hem portion and is secured at one end to the central region of the front hem by suitable fastening means 52 such as stitching, pivot fasteners and the like. The opposite end of reinforcement strap 50 is releasably secured to hem 28 towards the side of the garment by any suitable quick release fastener device, such as a snap fastener, a button fastener, releasable hook and loop fastener material such as VELCRO®, or the like. In the illustrated embodiment, the fastener device can comprise opposing mateable strips 54 of hook and loop fastener material, respectively, at the reinforcement strap end and an opposing region of hem 28. In alternative embodiments the fastener device can be a snap, hook and loop, button or the like. In some variations, reinforcement strap 50 is of flexible or elasticated material. In some embodiments, the reinforcement strap 50 is longer and may extend around half of the base or seam of the shirt, and be adapted to swing up like a purse strap when needed.

FIG. 13A illustrates garment or shirt 10 in conventional wearing mode. Outer layer 12 has strips 55 of hook or loop fastener material or other fastener devices such as snap fasteners at each shoulder, for releasably securing to corresponding loop or hook fastener material or other mating fastener 54 at the end of reinforcement strap 50 in the operative condition, as described in more detail below. FIGS. 13B to 13E illustrate steps in converting the outer layer 12 into a first carry mode and into a second, opposite carry mode. As illustrated in FIG. 13B, as in FIG. 8B in the first embodiment, the wearer 40 first inserts one hand and arm (in this case the left hand 41) through the opening or slit 26 on the same side of the outer layer 12 while the opposite hand (right hand 43) turns the lower part of the outer layer inside out and moves the part of the outer layer on the wearer's left arm up and over the left shoulder to form the basic sling as in FIG. 9. The wearer then places the baby 44 in the sling or carrier, and uses their right or left hand to tighten and cinch the cord tightly with toggle or clasp 35. At this point, the wearer can release the end of reinforcement strap 50 from the hem region of the garment and move the reinforcement strap upwards to the right shoulder, securing the reinforcement strap end to the shoulder via the mating fastener strips 54, 55 or other suitable quick release fastener mechanism, as illustrated in FIG. 13C. The quick release mechanism may be similar to the fasteners 17 on the inner layer straps 15 illustrated in FIGS. 3A and 3B in some embodiments, and the reinforcement strap may also include a length adjuster 21. FIGS. 13D and 13E illustrate the same conversion but with the sling angled in the opposite direction, from the right shoulder downwards, and the reinforcement strap 50 secured to the left shoulder.

The convertible garment described in the above embodiments and alternatives is readily convertible between carry and cover modes. The outer layer may be made of a suitable breathable fabric for comfort and coolness in both carrying and feeding. In one embodiment, the garment includes both inner and outer layers, while other embodiments may comprise a single layer garment designed to be worn over the user's existing clothing, such as shirts, tank tops, camisoles, tank tops with built in nursing bra, and the like. In the carry mode, the outer layer or garment is readily converted to form a sling-like carrier extending down to the left or to the right, for left or right handed users. In the carry mode, the sling-like carrier may be used for carrying a baby or other animate or inanimate objects, such as small pets or shopping items. In the cover mode, complete or substantially complete 360 degree coverage is provided for the mother both while preparing for nursing and during nursing, avoiding the inconvenience and incomplete coverage of existing, separate nursing covers which are likely to leave gaps when the baby moves or the like. The garment is quickly and easily convertible from carry mode to cover mode and vice versa, and allows left or right hand usage in either mode.

In the two layer garment, the inner layer is also of a suitable breathable fabric and has releasable straps to provide an easily accessible front panel opening for breast feeding while completely covered by the outer layer in the cover mode. The side openings or faux pockets in the outer layer allow the mother to readily insert a hand and arm between the inner and outer layers for supporting the baby discretely, without having to lift up the lower edge of the front panel. In some embodiments, when a selected strap is released and the front of the garment is folded down on the released side, an anchor flap secures the free strap end to the side of the garment so that it does not snap back behind the wearer's back. This is similar to nursing bra anchor flaps. In yet other embodiments the garment 10 can have a built in bra.

This garment can be constructed in different fabrics and designs and with different types of finishing. In each different design, the lower edge of the outer layer is sufficiently loose fitting to allow adequate space for use in the feeding mode and for sufficient material for use in the carrier mode. The toggle closures may be replaced by other tightening means such as elastic or other types of closure for adjustable clasping of cords and the like, and may be adorned in any form or fashion, such as charms, ribbons, beads, or the like. The closure may be replaced by elasticated material around the base of the garment in some embodiments, or other tightening devices to keep the sling tight enough to bear the carried weight. The garment design may use pleats, peplums, A-line, or any method suitable for providing sufficient fabric to accommodate the sling and cover functions. The shirt or garment may be a single layer for wearing over existing clothing, or may be two separate parts with the inner part including or excluding a built in nursing bra.

The convertible garment described above avoids the need for parents or other childcare providers to carry a separate baby carrier, bring a stroller, or bring a separate baby cover for feeding purposes, and allows a baby to be carried close to the body for bonding purposes while walking, traveling, shopping or the like while providing for privacy when breast feeding a baby in a non-private environment. This allows parents and others to conveniently carry a child close to their body without having to attach a separate baby carrier device, which is sometimes a difficult process without a second person to hold the baby while a first person dons a separate carrier. It will be understood that the convertible garment also allows for use in other capacities, for example to carry a pet such as a dog, cat or the like, or to carry shopping or other supplies in a convenient manner.

The accompanying claims and their equivalents are intended to cover such forms or modifications as would fall within the scope and spirit of the protection. The foregoing method descriptions and the process flow diagrams are provided merely as illustrative examples and are not intended to require or imply that the steps of the various embodiments must be performed in the order presented. As will be appreciated by one of skill in the art the order of steps in the foregoing embodiments may be performed in any order. Words such as "thereafter," "then," "next," etc. are not intended to limit the order of the steps; these words are simply used to guide the reader through the description of the methods. Further, any reference to claim elements in the singular, for example, using the articles "a," "an" or "the" is not to be construed as limiting the element to the singular.

Although the present disclosure provides certain example embodiments and applications, other embodiments that are apparent to those of ordinary skill in the art, including embodiments which do not provide all of the features and advantages set forth herein, are also within the scope of this disclosure. Accordingly, the scope of the present disclosure is intended to be defined only by reference to the appended claims.

What is claimed is:

1. A garment comprising:

an item of clothing configured to cover at least a major portion of the torso of a wearer's body in a first, cover mode and convertible between the cover mode and a second, carrier mode, the item of clothing comprising at least an outer layer of fabric material having an outer surface, an inner surface, a neck opening, a back, a front, opposite sides, opposite left and right arm openings, and a lower portion including a hem portion, the outer layer being configured to be a loose fit over at least the wearer's torso in the cover mode;

the opposite sides each having a faux pocket slit spaced below the respective arm opening configured for insertion of a wearer's arm on the same side through the faux pocket slit and beneath the outer layer; and a second, inner layer attached to the first layer and configured to cover at least an upper portion of a wearer's torso, the inner layer having a tighter fit to the wearer's body than the first layer, wherein the first layer is permanently or releasably attached to the inner layer of the garment;

whereby the wearer can turn a lower portion of the outer layer inside out by inserting one arm through the faux pocket slit on the same side of the body and move the slit along the arm and over the shoulder to form a sling-like carrier for a baby at the front of the wearer's body in the carry mode of the garment.

2. The convertible garment of claim 1, wherein the item of clothing comprises a single layer adapted for wearing over a wearer's inner, closer fitting garment in the cover and carry modes.

3. The convertible garment of claim 1, wherein the first and second layers have shoulder engaging regions and are attached together at the shoulder engaging regions.

4. The convertible garment of claim 1, wherein the second, inner layer has a front, a back, and shoulder straps connected between upper portions of the front and back, each shoulder strap having a front portion and a fastener releasably connecting the front portion to an upper portion of the inner layer, whereby a selected fastener can be released for baby feeding purposes, and the first layer is configured to allow a wearer to access the fasteners with the garment in a cover mode by inserting an arm through a selected faux pocket slit and into the space between the first and second layers.

5. The garment of claim 4, wherein the upper portion of the inner layer includes a nursing bra.

6. The garment of claim 1, wherein the sling-like carrier in the carry mode has an adjustable carrier opening defined between the hem portion of the front of the first layer and an opposing front portion of the first layer, the hem portion including a tightening mechanism for tightening the front hem portion in the carry mode to reduce the size of the carrier opening.

7. The garment of claim 6, wherein the hem portion defines front and back channels between opposite sides of the first layer and the tightening mechanism comprises at least one elongate member extending through the channels at the front and back of the first layer between opposite sides of the first layer and having loose end portions extending out of the channels at each side of the first layer, and right and left releasable fastener devices on the inside of the first layer in the cover mode configured for cinching the loose end portions and releasable to allow adjustment of the length of the loose end portions extending out of the channels in order to reduce or increase the size of the carrier opening when converting from cover to carry mode and from carry to cover mode, respectively.

8. The garment of claim 7, wherein the releasable fastener devices are selected from the group consisting of ties, snaps, buttons, buckles, clasps, toggles, latches, and hook and loop fastener material.

9. The garment of claim 1, further comprising a ring or loop secured to the hem portion at the front of the first layer.

10. The garment of claim 1, wherein the carry mode includes a right carry mode in which the right side faux pocket slit is supported on the wearer's right shoulder and the carrier sling extends downwards across the wearer's body from the shoulder towards the opposite side of the body and a left carry mode in which the left side faux pocket slit is supported over the wearer's left shoulder and the carrier sling extends downwards across the wearer's body towards the opposite side of the body.

11. The garment of claim 10, further comprising a reinforcement strap having a first end secured on the inner surface of the first layer and a second end releasably secured to the inner surface in the cover mode, the first layer having right and left shoulder regions and each shoulder region having a releasable fastener device, the second end of the reinforcement strap being releasably securable to the releasable fastener device on the right shoulder region in the left carry mode and to the releasable fastener device on the left shoulder region in the right carry mode, with the strap extending from the hem portion to the respective shoulder.

12. A garment comprising:

an item of clothing configured to cover at least a major portion of the torso of a wearer's body in a first, cover mode and convertible between the cover mode and a second, carrier mode, the item of clothing comprising at least an outer layer of fabric material having an outer surface, an inner surface, a neck opening, a back, a front, opposite sides, opposite left and right arm openings, and a lower portion including a hem portion, the outer layer being configured to be a loose fit over at least the wearer's torso in the cover mode; and the opposite sides each having a faux pocket slit spaced below the respective arm opening configured for insertion of a wearer's arm on the same side through the faux pocket slit and beneath the outer layer;

whereby the wearer can turn a lower portion of the outer layer inside out by inserting one arm through the faux pocket slit on the same side of the body and move the slit along the arm and over the shoulder to form a sling-like carrier for a baby at the front of the wearer's body in the carry mode of the garment;

wherein the sling-like carrier in the carry mode has an adjustable carrier opening defined between the hem portion of the front of the first layer and an opposing front portion of the first layer, the hem portion including a tightening mechanism for tightening the front hem portion in the carry mode to reduce the size of the carrier opening; and wherein the hem portion defines front and back channels between opposite sides of the first layer and the tightening mechanism comprises at least one elongate member extending through the channels at the front and back of the first layer between opposite sides of the first layer and having loose end portions extending out of the channels at each side of the first layer, and right and left releasable fastener devices on the inside of the first layer in the cover mode configured for cinching the loose end portions and releasable to allow adjustment of the length of the loose end portions extending out of the channels in order to reduce or increase the size of the carrier opening when converting from cover to carry mode and from carry to cover mode, respectively.

13. The convertible garment of claim 12, wherein the item of clothing comprises a single layer adapted for wearing over a wearer's inner, closer fitting garment in the cover and carry modes.

14. The convertible garment of claim 12, further comprising a second, inner layer attached to the first layer and configured to cover at least an upper portion of a wearer's torso, the inner layer having a tighter fit to the wearer's body than the first layer.

15. The garment of claim 12, further comprising a ring or loop secured to the hem portion at the front of the first layer.

16. A garment comprising:

an item of clothing configured to cover at least a major portion of the torso of a wearer's body in a first, cover mode and convertible between the cover mode and a second, carrier mode, the item of clothing comprising at least an outer layer of fabric material having an outer surface, an inner surface, a neck opening, a back, a front, opposite sides, opposite left and right arm openings, and a lower portion including a hem portion, the outer layer being configured to be a loose fit over at least the wearer's torso in the cover mode; and the opposite sides each having a faux pocket slit spaced below the respective arm opening configured for insertion of a wearer's arm on the same side through the faux pocket slit and beneath the outer layer;

whereby the wearer can turn a lower portion of the outer layer inside out by inserting one arm through the faux pocket slit on the same side of the body and move the slit along the arm and over the shoulder to form a sling-like carrier for a baby at the front of the wearer's body in the carry mode of the garment;

wherein the carry mode includes a right carry mode in which the right side faux pocket slit is supported on the wearer's right shoulder and the carrier sling extends downwards across the wearer's body from the shoulder towards the opposite side of the body and a left carry mode in which the left side faux pocket slit is supported over the wearer's left shoulder and the carrier sling extends downwards across the wearer's body towards the opposite side of the body, further comprising a reinforcement strap having a first end secured on the inner surface of the first layer and a second end releasably secured to the inner surface in the cover mode, the first layer having right and left shoulder regions and each shoulder region having a releasable fastener device, the second end of the reinforcement strap being releasably securable to the releasable fastener device on the right shoulder region in the left carry mode and to the releasable fastener device on the left shoulder region in the right carry mode, with the strap extending from the hem portion to the respective shoulder.

17. The convertible garment of claim 16, wherein the item of clothing comprises a single layer adapted for wearing over a wearer's inner, closer fitting garment in the cover and carry modes.

18. The convertible garment of claim 16, further comprising a second, inner layer attached to the first layer and configured to cover at least an upper portion of a wearer's torso, the inner layer having a tighter fit to the wearer's body than the first layer.

* * * * *